US008896400B1

(12) United States Patent
Harris et al.

(10) Patent No.: US 8,896,400 B1
(45) Date of Patent: Nov. 25, 2014

(54) ULTRATHIN WAVEGUIDE BEAMFORMER

(75) Inventors: Daniel W. Harris, Mount Laurel, NJ (US); Andrew R. Mandeville, Delran, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 253 days.

(21) Appl. No.: 13/399,605

(22) Filed: Feb. 17, 2012

(51) Int. Cl.
*H01P 1/00* (2006.01)
*H01P 1/04* (2006.01)

(52) U.S. Cl.
USPC ..... 333/248; 333/254

(58) Field of Classification Search
USPC ..... 333/117, 122, 137, 157, 208, 239, 248, 333/254
See application file for complete search history.

(56) References Cited

U.S. PATENT DOCUMENTS 6,842,631 B1 * 1/2005 Allen et al. ..... 455/562.1
7,626,556 B1 * 12/2009 Pluymers et al. ..... 343/754
8,081,045 B1 * 12/2011 Zeweri et al. ..... 333/124

* cited by examiner

*Primary Examiner* — Dean O Takaoka
(74) *Attorney, Agent, or Firm* — Howard IP Law Group PC

(57) ABSTRACT

An ultrathin, low cost, beamformer with excellent RF performance and robust coaxial connections is disclosed. The beamformer includes a dielectric substrate sheet with a beamformer circuit, a preform sheet adjacent to the substrate sheet, and a conductive backing plate sandwiching the preform as well as an RF absorber. The beamformer also includes robust input and output coaxial connections in which the heads of the coaxial input and output pins are captured between the conductive backing plate and the substrate sheet and ground shrouds are attached to the dielectric substrate sheet.

27 Claims, 10 Drawing Sheets

Back View

Front View

Back View

Front View

ULTRATHIN WAVEGUIDE BEAMFORMER

FIELD OF THE INVENTION

The present invention relates to an ultrathin waveguide beamformer, and more particularly to a method and apparatus for an ultrathin waveguide beamformer.

BACKGROUND OF THE INVENTION

Millimeter wave phased array antennas and subassemblies require Ultrathin Waveguide Beamformers that are significantly thinner and higher performance than those currently available using traditional design and manufacturing techniques. The beamformers must include robust coaxial connectors and RF absorbers at the lowest cost possible.

High frequency beamformers have been implemented in primarily two ways: 1) Air cavity waveguides and; 2) Stripline circuits. Both types have significant drawbacks.

Air cavity waveguides are hollow rectangular metal tubes which are sized to support the transmission of a microwave. The cross section of the tube is a function of the microwave frequency. Couplers for dividing/combining microwave signals can be implemented in a waveguide to create a beamforming network. The terminated port of a waveguide coupler requires an absorptive material to be integrated into the terminated waveguide port. Connectors are implemented by using the coax center pin to launch a wave into the waveguide cavity. Air cavity waveguides are very expensive, and difficult to manufacture at high frequencies where the cross section of the tubes become increasingly smaller and their overall thickness does not fit within the lattice spacing of high frequency phased arrays.

Alternately, stripline beamformers have also been used. The stripline consists of a transmission line sandwiched between two ground conductors with a dielectric material between them. The terminated port of a stripline coupler is typically implemented with a discrete or film resistor which is part of the stripline conductor. Connectors are typically implemented by soldering the coax center pin to the stripline circuit. The disadvantage of this approach is that as the operating frequency increases above ~20 GHz the conductor loss (even using copper conductors) becomes highly undesirable. The only way to reduce the loss is to increase the stripline width which increases the dielectric thickness or alternately the dielectric constant.

In addition, the design of the stripline beamformer is more difficult to manufacture and makes it difficult to implement robust coaxial connections. As shown in FIG. 9, which depicts a prior art implementation of a stripline beamformer, the stripline circuit requires lamination of two separate dielectric substrates 905 and 910, one containing a ground plane 920 and one containing a ground plane 920 and a transmission line 915. The transmission line 915 is sandwiched between the ground planes 920 when the substrates 905 and 910 are laminated together. Plated vias (not shown) are then added to form ground walls around the stripline circuit 915. Traditional stripline design uses resistors or resistor films buried in the substrate and soldered to the stripline to effect RF absorption.on the termination point. However, heat dissipation from this design is poor because the resistor has to conduct through the substrate, which is a poor thermal conductor. This inability to efficiently dissipate heat limits the power handling capabilities of the beamformer.

In addition, the coaxial connector design on stripline beamformers is susceptible to damage because of its complicated construction. As shown in FIG. 9, the head 925 of the coaxial pin 930 for the center conductor of the connector is soldered to the stripline 915, which provides a rather weak connection. One side of the pin is supported by the thin substrate and the other side is supported by epoxy backfill 935. It is not uncommon for the connection between the pin and stripline to be damaged or for the pin itself to be dislodged. Perhaps most importantly, the complicated coaxial connector design for the stripline beamformers has been found to provide poor RF performance.

Notably, with either air cavity waveguides or stripline beamformers, there is a limit to how thick the circuit can be made because higher level modes will be supported which takes energy away from the fundamental wave. Increasing thickness to reduce loss also limits the ability of the circuit to fit within the lattice spacing of high frequency phased arrays.

Thus there is a need for an ultrathin, low cost, beamformer with excellent RF performance and robust coaxial connections.

SUMMARY OF THE INVENTION

A waveguide beamformer comprises a dielectric substrate sheet, a conductive preform, a backplate, and input and output coaxial connectors. The dielectric substrate sheet has conductive cladding and includes an RF circuit, a substrate input pin hole within an input section of the RF circuit, and a substrate output pin hole within an output section of the RF circuit. The conductive preform is adjacent to a first side of the dielectric substrate sheet, and includes a preform input pin hole coaxial with the substrate input pin hole, and a preform output pin hole coaxial with the substrate output pin hole. An input pin is disposed coaxially within the preform input pin hole and the substrate input pin hole, the input pin having an input pin head section and input pin body section, wherein the input pin head section is generally coplanar with the conductive preform. An output pin is disposed coaxially within the preform output pin hole and the substrate output pin hole, the output pin having an output pin head section and output pin body section, wherein the output pin head section is generally coplanar with the conductive preform. A conductive backplate is adjacent to the conductive preform, the conductive backplate and the dielectric substrate sheet sandwiching the conductive preform, the input pin head section and the output pin head section. An input ground shroud is attached to a second side of the dielectric substrate sheet and coaxial with the input pin body section, thereby creating an input coaxial connection. An output ground shroud is also attached to the second side of the dielectric substrate sheet and coaxial with the output pin body section, thereby creating an output coaxial connection.

A method for fabricating a waveguide beamformer is also disclosed. The method comprises providing a dielectric substrate sheet having conductive cladding and providing a conductive backplate sheet. A waveguide circuit is formed on the dielectric substrate sheet. A substrate input pin hole is drilled into the dielectric substrate sheet within a waveguide circuit input section, and a substrate output pin hole is drilled into the dielectric substrate sheet within a waveguide circuit output section. A conductive preform is mated to the conductive backplate sheet, the conductive preform including a preform input pin hole coaxial with the substrate input pin hole and a preform output pin hole coaxial with the substrate output pin hole. Then, an input pin is perpendicularly disposed coaxially within the preform input pin hole and the substrate input pin hole such that an input pin head section is coplanar to the preform input pin hole. Similarly, an output pin is perpendicularly disposed coaxially within the preform output pin hole and the substrate output pin hole such that an output pin head section is coplanar to the preform output pin hole. The dielectric substrate sheet is then mated to the conductive preform such that the substrate input pin hole is coaxial with the input pin and the substrate output pin hole is coaxial with the output pin, thereby sandwiching the conductive preform, the input pin head section and the output pin head section between the conductive backplate sheet and the dielectric substrate sheet. Finally, a input coaxial ground shroud is attached to the second side of the dielectric substrate sheet coaxially with an input pin body section of the input pin thereby creating an input coaxial connection; and an output coaxial ground shroud is attached to the second side of the dielectric substrate sheet coaxially with an output pin body section of the output pin, thereby creating an output coaxial connection.

DETAILED DESCRIPTION

Figure 1:
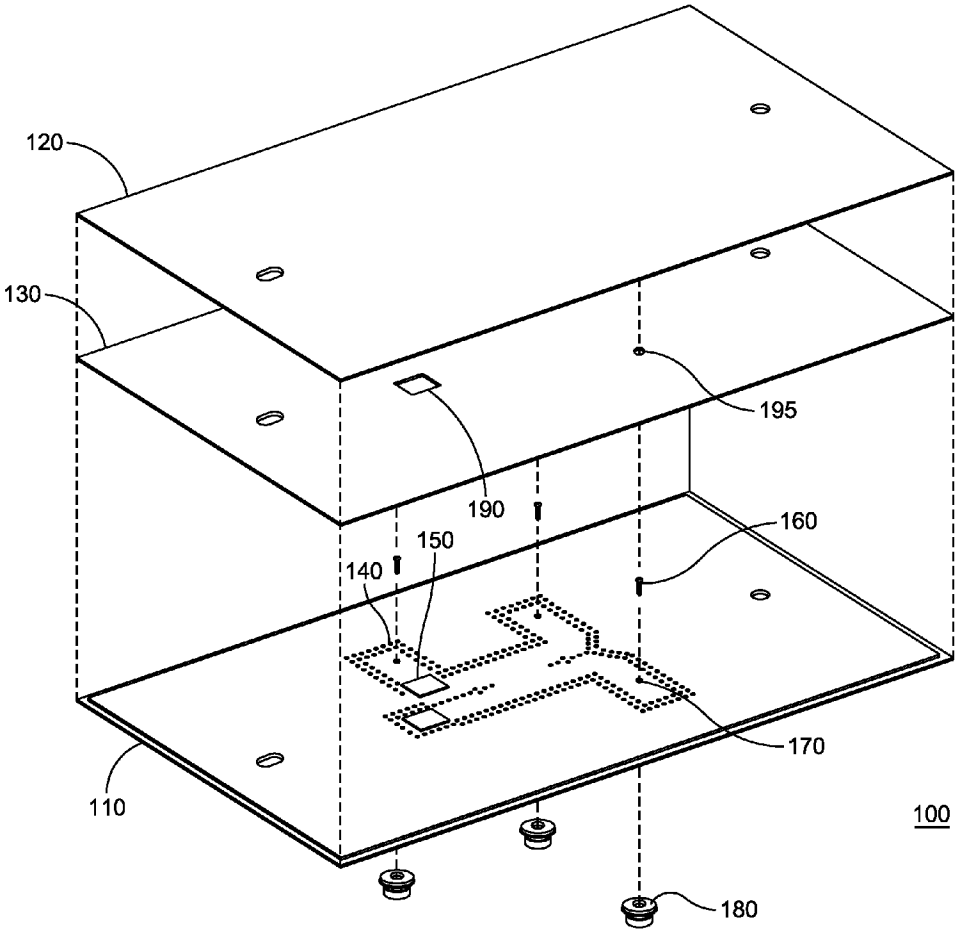
FIG. 1 is an exploded assembly of an ultrathin beamformer according to an aspect of the disclosure.

This invention provides a technique for fabrication of low cost, high performance, ultra thin waveguide beamformer using a monolithic copper clad dielectric sheet with coaxial connector interfaces and absorptive termination ports supported by a conductive backplate.

Reference will now be made to various embodiments of the invention, examples of which are illustrated in the accompanying drawings. Wherever possible, the same reference numbers will be used throughout the drawings to refer to the same or like parts. It is to be understood that the figures and descriptions of the present invention have been simplified to illustrate elements that are relevant for a clear understanding of the present invention, while eliminating, for purposes of clarity, many other elements found in typical ultrasonic transducers. Because such elements are well known in the art, and because they do not facilitate a better understanding of the present invention, a discussion of such elements is not provided herein. The disclosure herein is directed to all such variations and modifications known to those skilled in the art.

In addition, this description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

A low cost beamformer with excellent RF performance and robust coaxial connections is disclosed. In order to realize a low cost solution, the beamformer needs to be designed for fabrication using commercially available materials and processes. The waveguide may be manufactured from a commercially available sheet of dielectric, with copper cladding on both sides, which is bonded to a conductive backplate. A low cost solution also needs to minimize the number of processing steps required to fabricate the design. There is no processing of complex machined cavities to form an air waveguide. There is no processing of multiple sheets of dielectric followed by bonding of the materials together as with stripline circuits.

The RF performance is excellent because there are no conductor losses using a dielectric waveguide. By using a low dielectric constant material this approach has a loss that is only slightly higher than an air waveguide. Good RF performance at millimeter wave frequencies strongly depends on the loss of the materials used and the ability to minimize reflections at discontinuities which are inherent in all RF circuit designs. Implementing an absorbing material for the coupler terminated port resistor also contributes to reduced cost by eliminating the need to apply absorbing material inside air waveguides or the need to solder discrete resistors to stripline couplers.

The single dielectric beamformer is extremely thin (~15 mils at 35 GHz) because a dielectric filled waveguide is smaller in size than an air dielectric by a factor of the square root of the dielectric material. The connector implementation is very robust because the center conductor pin is soldered to the outer copper cladding of the dielectric and then sandwiched between the dielectric and the backplate which is bonded to the dielectric. The conductive backplate provides structure to the substrate and coax connector center pin and a means of heat sinking for the RF absorbing material. The integration of a coaxial connector accommodates interface to next higher assembly components. As the thickness of the dielectric decreases this becomes increasingly more difficult because the inherently weak substrates can't support the center pin of the connector. The design and fabrication technique described in this disclosure provides a solution which addresses each of these desirable characteristics, enabling the construction of a millimeter wave beamformer circuit that is thin enough to fit within the lattice spacing of millimeter wave phased array antennas.

FIG. 1 shows a beamformer 100 according to an embodiment of the invention. The beamformer includes a dielectric substrate sheet clad in a conductive material 110 such as copper. The substrate may be made of duroid or a Teflon based material. The beamformer 100 also includes a backplate 120, which is attached to the dielectric substrate sheet 110 with a conductive preform 130. The dielectric substrate sheet 110 includes beamformer circuit 140, and beamformer circuit includes an RF absorber 150 and coaxial pins 160. Each coaxial pin 160 is mated to a coaxial connector ground shroud 180.

Figure 2B:
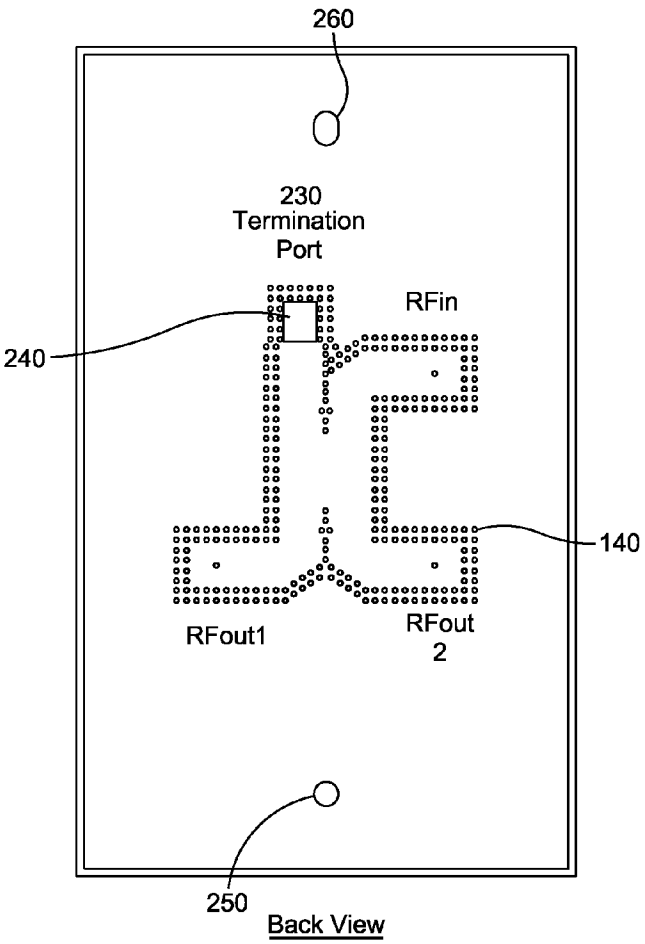
FIG. 2*b* is a plan view of the reverse side of the dielectric substrate sheet of FIG. 2*a;*
Figure 2A:
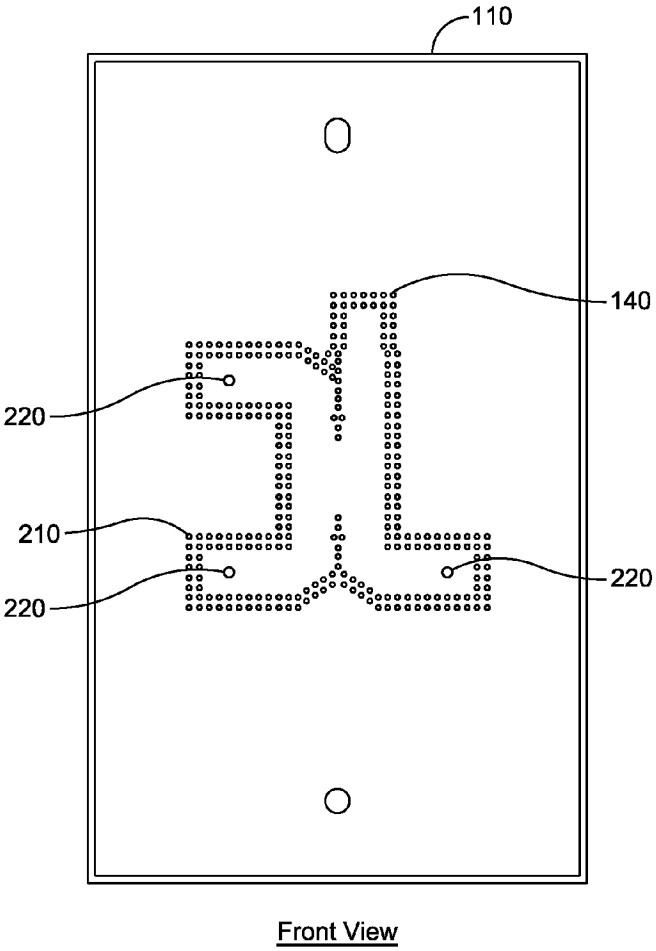
FIG. 2*a* is a plan view of a dielectric substrate sheet including a circuit.

FIGS. 2A and 2B show detailed drawings of the dielectric substrate sheet 110. FIG. 2A shows the "front" of the dielectric substrate sheet, which is the side that faces away from the preform 130 and backplate 120, and FIG. 2B shows the "back" of the dielectric substrate sheet 110, which is the side that faces towards the preform 130 and backplate 120. Both FIG. 2A and FIG. 2B show RF waveguide circuit 140. The RF waveguide circuit is comprised of a plurality of plated vias 210 that are formed in the dielectric sheet 110 by drilling holes through the dielectric followed by copper plating of the hole using conventional printed wire board plating processes. The copper cladding and rows of plated vias form a dielectric loaded waveguide cavity which can be used to transmit a microwave. RF energy can be divided/combined by the beamformer circuit by creating openings in the via walls and coupling energy to additional waveguide ports.

In the embodiment of FIGS. 2A and 2B, there are no signal vias or transmission line conductors. As a result, the RF circuit is formed simply by drilling and plating ground vias to establish waveguide cavities and dividers of any shape, size or complexity. RF energy is launched into the cavity through the coax center pin which is terminated on the ground plane of the substrate and mechanically captured between the substrate and the backplate. This approach is inherently low cost because the materials are low cost (conventional copper cladded teflon based substrate, conventional epoxy preform, stainless steel sheet stock, conventional RF absorbing sheet material, commercially available coax connectors) and the processing of the materials (drilling, plating and etching of teflon based substrate, punching of epoxy preform to desired shape, machining of backplate to desired shape and cutting of RF absorber sheet followed by a bonding operation) to form a RF Divider/Combiner circuit are greatly minimized.

The embodiment shown in FIGS. 2A and 2B includes a simple 2:1 combiner or divider circuit (it may be used for either) that includes three ports that may function as inputs/outputs. As will be understood, when used as a combiner, two of the ports are input ports and one is an output port. When used as a divider, one of the ports is an input port and two are output ports, as is shown in FIG. 2B where RFin is the RF (or waveguide) input port for the RF waveguide circuit and RFout1 and RFout2 are the RF (or waveguide) output ports of the RF waveguide circuit. Holes 220 are made in the copper cladding of the dielectric substrate sheet 110 so that a coaxial pin and shroud (not shown) can be coupled to the substrate. The 2:1 combiner/divider as shown in FIGS. 2A and 2B also include a waveguide (RF) circuit termination port 230 for an RF Absorber (not shown). The terminated port may include a 50 ohm RF absorber to dissipate energy that would otherwise reflect back into the coupler and degrade its performance. FIG. 2B shows an opening 240 in the copper cladding (which is also the ground plane) that is made for the RF absorber. The dielectric substrate sheet 110 may also include alignment hole 250 and alignment slot 260. FIG. 2C shows coaxial connectors 180 that may be coupled to the input and output ports of the beamformer circuit on the dielectric substrate sheet 110.

Figure 2D:
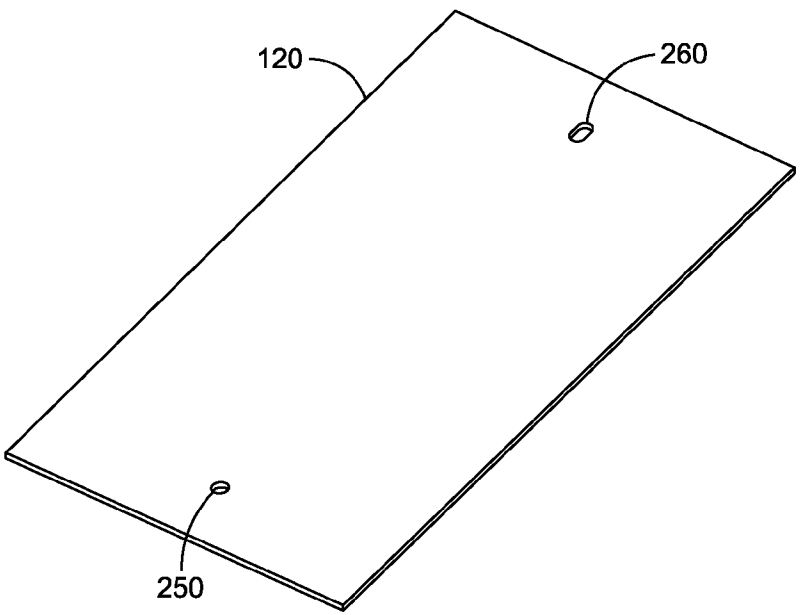
FIG. 2*d* is a perspective view of the other side of the conductive backplate of FIG. 2*c;*
Figure 2C:
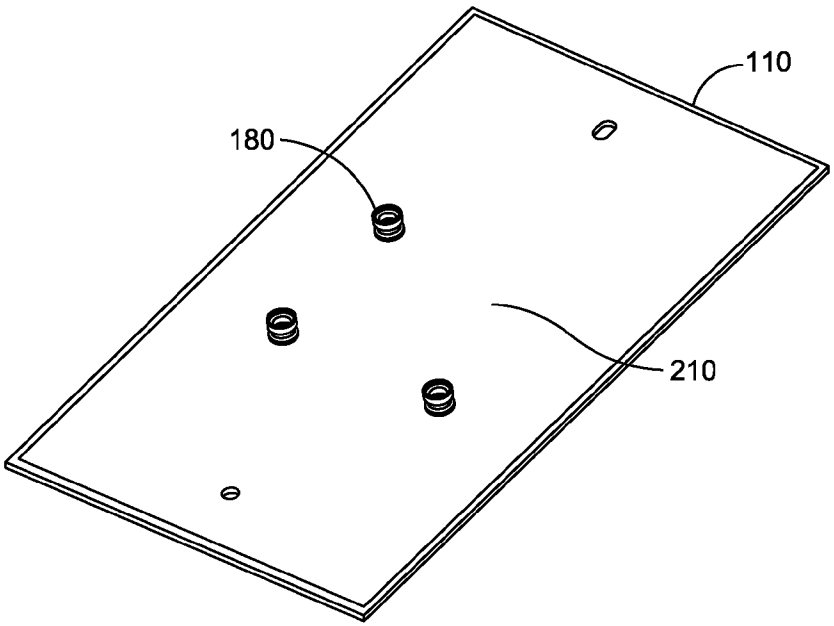
FIG. 2*c* is a perspective view of the conductive backplate of an embodiment of the invention.

FIG. 2D shows a view of the conductive backplate 120. The backplate 120 is made of a conductive material such as stainless steel, copper, or brass, and may include alignment hole 250 and alignment slot 260, which allow the backplate 120 to be aligned with the dielectric substrate sheet 110. The backplate is an important element of the invention because substrate thickness must decrease as frequency increases in order to transmit energy in a waveguide cavity. Therefore, low loss, high frequency substrates are made from soft materials such as Teflon for these applications and the substrate must be increasingly thin to handle higher frequencies. As the substrate becomes thinner (~15 mils at 35 GHz for example), it cannot hold its shape, provide volume to integrate an absorber and is not able to mechanically support a coaxial connector center pin. A thin conductive backplate (~8 mil thick stainless steel for example) gives the substrate mechanical strength, may provide a pocket for mounting and heat sinking of an RF absorber, and allows a coaxial connector center pin to be mechanically captured without damaging the substrate as it interface with its next higher assembly. Stainless steel is a good material choice because it has significantly more strength/inch of thickness than the substrate and has a relatively close matched coefficient of thermal expansion (CTE) to the waveguide substrate. However, alternate materials such as copper or brass can be used for improved thermal conductivity and CTE match. The conductive backplate can be attached to the waveguide substrate using epoxy or solder preforms.

Figure 3:
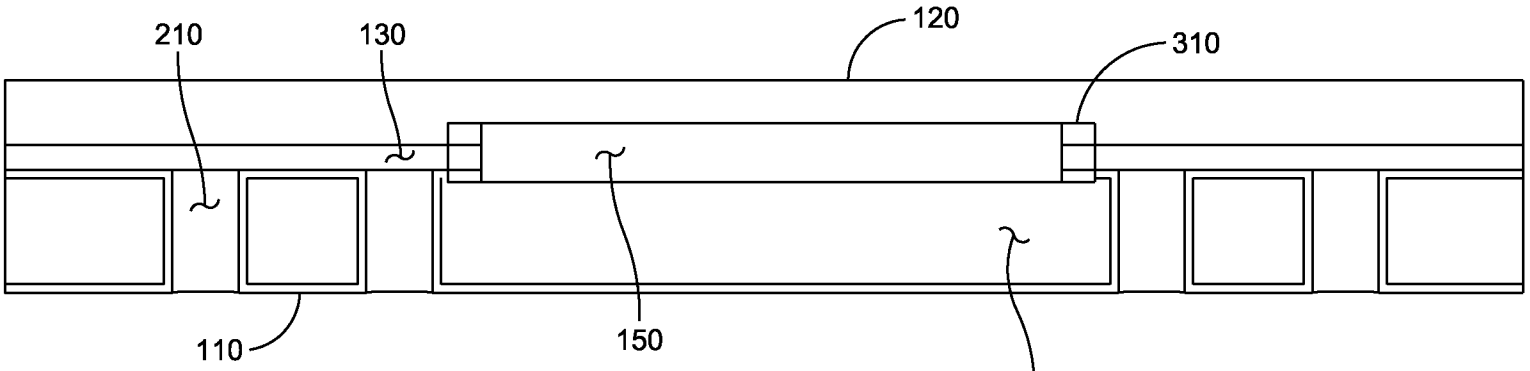
FIG. 3 is a section view of the beamformer at the RF Absorber in an embodiment of the invention.

FIG. 3 shows a cross-section of the beamformer 100 which includes the RF absorber 150 in termination port 230 (as shown on FIG. 2B). The termination port is capable of dissipating high RF power that would otherwise reflect back into the coupler and degrade its performance. Generally, the termination port is implemented by creating a space for the RF absorber 150 between the dielectric substrate sheet 110 and the backplate 120. In an embodiment, the termination port is implemented by creating an RF absorber opening 240 (as shown in FIG. 2B) in the copper cladding (i.e., ground plane) of the dielectric substrate sheet 110, an RF absorber opening 190 in the preform (as shown in FIG. 1), and an RF absorber recess 310 for the RF Absorber in the backplate 120. The RF absorber is held in place by the electrically conductive backplate which completes the waveguide cavity in the RF absorber section of the waveguide load port. This approach allows RF energy to travel into the RF absorber region of the load port without discontinuities which cause reflections. The recess or pocket 310 is machined in the conductive backplate 120 to ground the RF absorber 150 and provide a path for heatsinking the RF absorber material. The RF performance of the termination may provide excellent return loss by selecting a thin (10 mils for a 35 GHz coupler) commercially available absorbing material of low dielectric constant (such as Eccosorb type BSR) which does not cause a discontinuity as energy travels into the termination port 320. The length of the absorber is selected to insure the input RF energy is dissipated by the time it reaches the end of the absorber.

The approach of FIG. 3 allows for a very thin, low cost and high performance coupler termination. This configuration provides an efficient means for terminating the coupler load port with an RF absorbing material. Furthermore, by using high thermal conductivity backplate materials the coupler load port can be designed to handle high power dissipations. For example, the heat dissipating capability of the termination port can be greatly enhanced by mounting the backplate to a coldplate, integrating free or forced convection air cooling fins into the backplate above the RF absorber, or integrating liquid cooling channels into the backplate. Or in a more simple embodiment, heat can be dissipated directly to the surrounding air from the surface of the backplate or to the next higher assembly which is temperature controlled. These options demonstrate the scalability of the design to high RF power in the coupler load ports.

Figure 4:
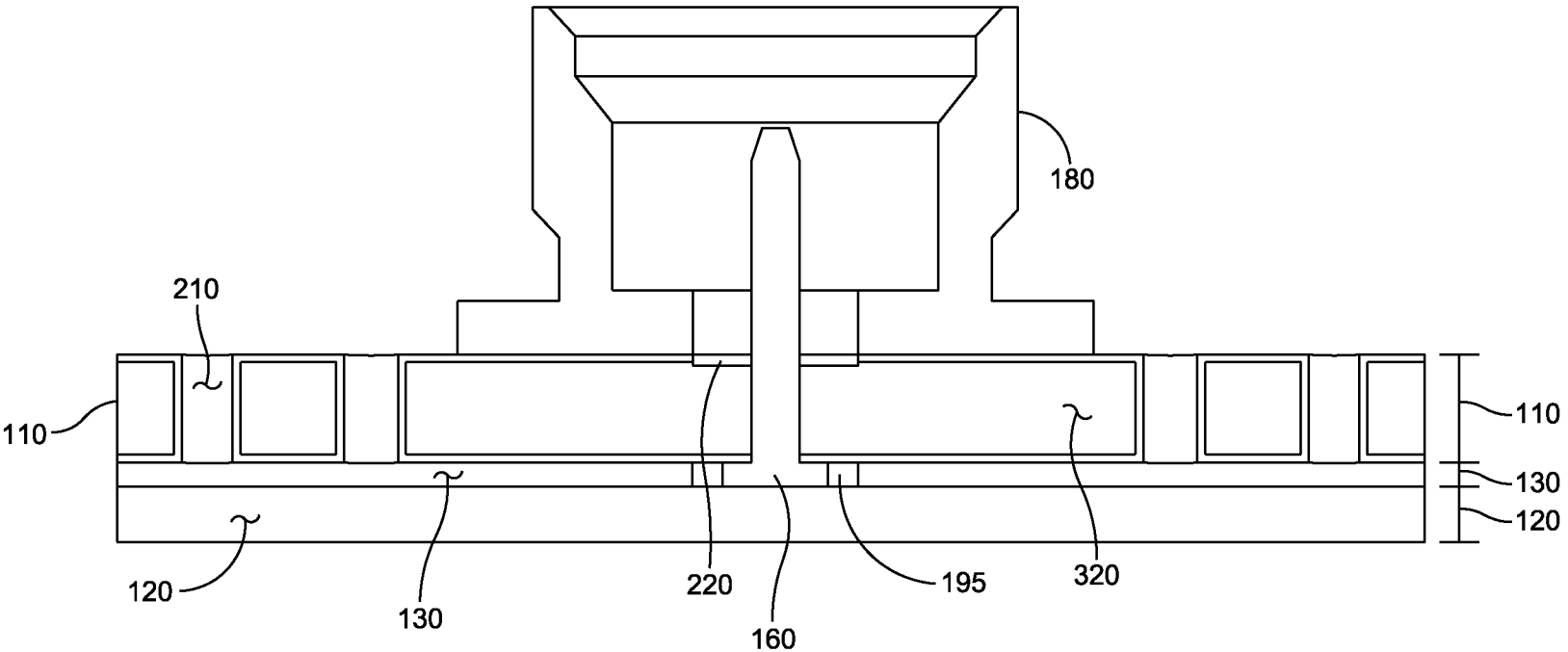
FIG. 4 is a section view of the beamformer at a coaxial connector in an embodiment of the invention.

FIG. 4 shows a section view of a novel method for implementing RF coaxial connectors in the beamformer 100, which are needed to efficiently transmit RF energy between RF components in a shielded, low loss manner. The transition between the connector and waveguide is designed as a shorted stub into the waveguide cavity. Using this method, the center pin 160 of the coaxial connector 180 is shorted to one of the waveguide ground planes (i.e., the copper cladding of the dielectric substrate sheet). This may be implemented by sandwiching a nail head pin 160 between the substrate 110 and the conductive backplate 120, such that the head section of the pin resides in the plane of the preform 130 (is generally co-planar with the preform) as shown in FIG. 4. The head section of the pin may also be soldered to the copper cladding (i.e., the waveguide ground plane) for added mechanical support and to insure good grounding. Supporting the pin in this manner insures it has the mechanical strength needed for high reliability even with a thin substrate. Without the backplate 120, the pin could not be supported by the thin and soft substrate materials typically used to form high frequency beamformer networks. FIG. 4 also shows coaxial connector 180, which may be soldered to the copper cladding of the dielectric substrate sheet 110. As shown, hole 220 (also shown in FIG. 2A) is made in the dielectric substrate sheet 110 to accommodate the body section of pin 160. Hole 220 may be made such that the copper cladding around the body of pin 160 is removed, so that the body of pin 160 does not make contact with the cladding on the side of the dielectric substrate sheet that faces away from the backplate 120. As will be understood, this type of connector configuration can be used for either RF waveguide input or RF waveguide output connections, using appropriate input and output holes in the substrate and preform.

Figure 5:
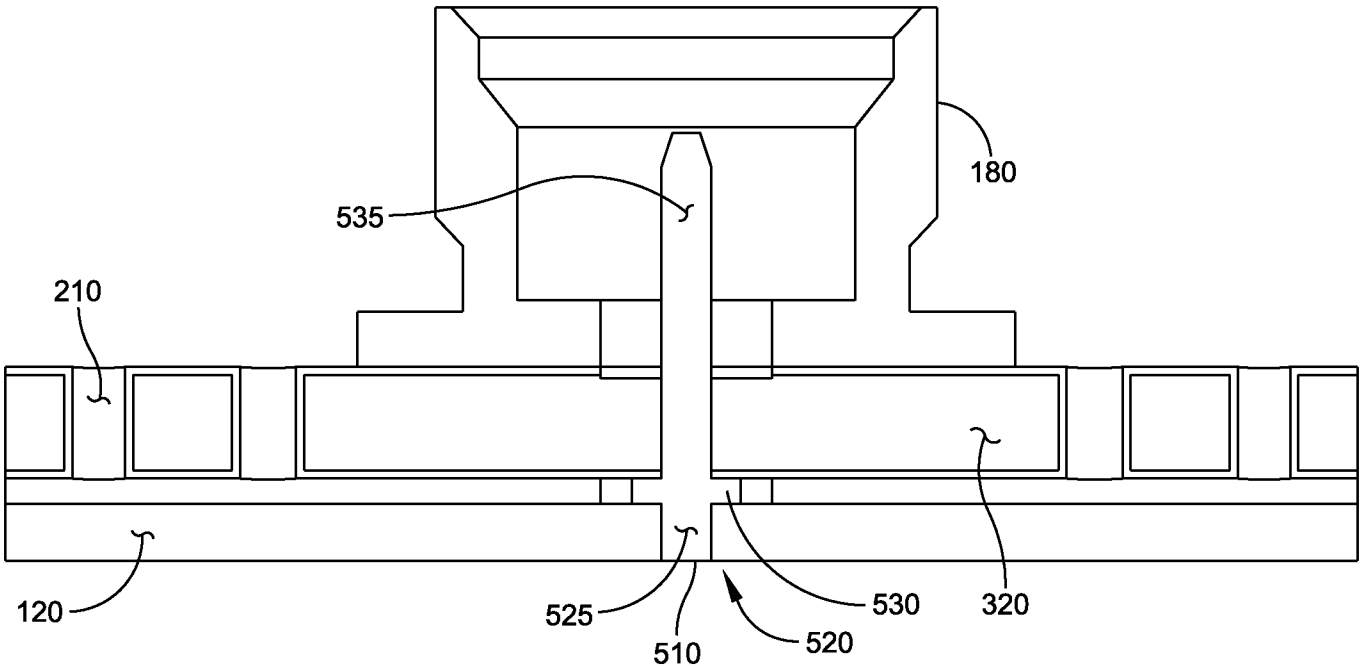
FIG. 5 is a section view of the beamformer at a coaxial connector in another embodiment of the invention.

FIG. 5 shows an alternate method for implementing RF coaxial connectors in the beamformer 100, using a shoulder pin 510 instead of a nailhead pin. The use of a shoulder pin 510 can provide additional mechanical strength for the coaxial connection, as the head 525 (or upper body section) of the shoulder pin can be held captive in the backplate 120. As will be understood, an appropriately sized hole 520 would need to be made in the backplate to allow the head of the shoulder pin to fit within the hole. In an embodiment, the head section can be press fit into the hole, and in another embodiment the head section of the shoulder pin can be epoxied into the hole. The shoulders 530 of the shoulder pin are sized so that they are generally co-planar with the conductive preform and are captured between the backplate and the dielectric substrate when those elements are put togehter. The grounding shroud of the connector is coaxial with the body section 535 and soldered to the opposite side of the waveguide substrate to complete the implementation of the coax connector to the substrate. Shoulder pins may be used for the RF waveguide input pins or the waveguide output pins using appropriate holes in the backplate, preform, and dielectric substrate. Likewise, shoulder pins may be used for throughput RF connections.

As shown in the cross-sections of FIGS. 4 and 5, the backplate 1) provides mechanical stiffness to the otherwise weak substrate of the dielectric substrate sheet 110; 2) provides a method for mounting and heatsinking the RF absorber on the terminated coupler ports and; 3) provides a method for securing the coax connector center pin so it has the strength to withstand multiple mate/de-mate cycles without damage. The unique integration of a coaxial connector and RF absorber into the dielectric substrate sheet provides a means to support the coax center pin and very efficiently launch energy into the waveguide cavity. In addition, the unique integration of the coaxial connector to the substrate allows for the use of the connector on ultrathin substrates, such that the thickness of the substrate can be minimized to the order of approximately 5 mils.

Importantly, the improved mechanical stiffness, heatsinking, and secure coax connector also result in improved performance over previous methods. For example, a 35 GHz beamformer has been realized using a 10 mil thick copper clad Duroid substrate with an 8 mil thick stainless steel backplate attached with a 2 mil thick epoxy preform, resulting in a 20 mil thick beamforming network with integrated 50 ohm termination and robust RF coax connectors for interface to other RF components in the system. Each coupler has a transmission line loss of only 0.4/dB/inch. By comparison, a stripline implementation would have a transmission line loss of 0.9 dB/inch. Furthermore, the thin size of the beamformer allows it to fit within the lattice of millimeter wave phase array antennas while leaving height for other components such as transmit/receive modules and power/control electronics.

Figure 6:
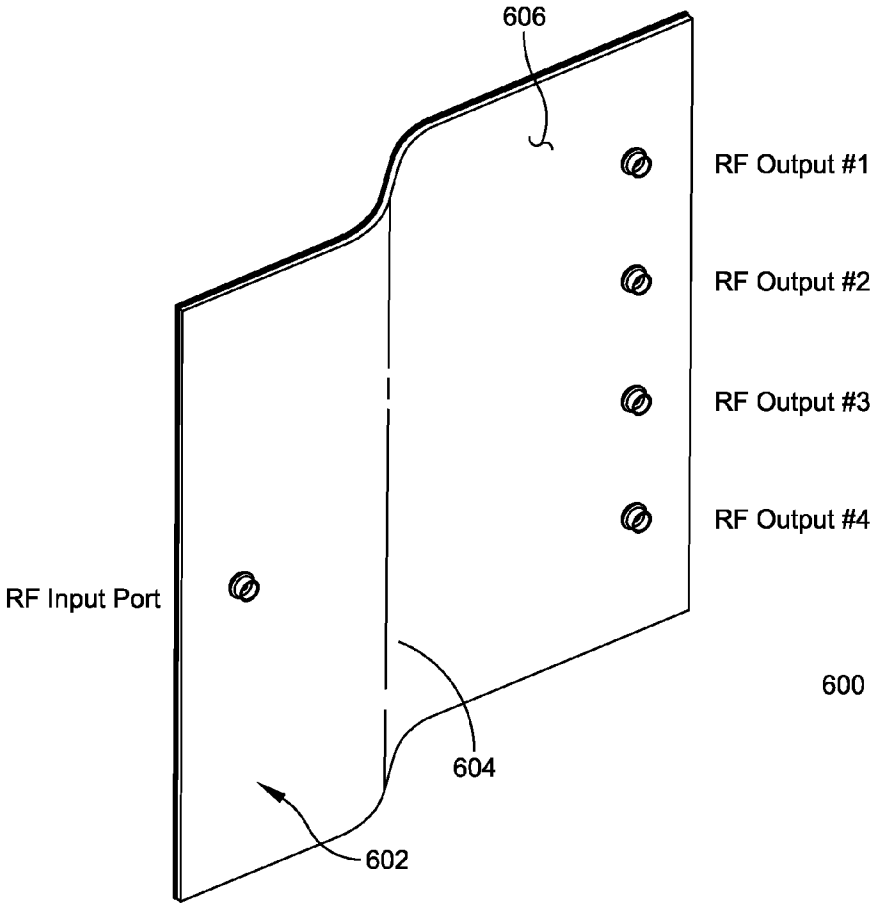
FIG. 6 is an exploded assembly of a non-planar beamformer according to an aspect of the disclosure.

FIG. 6 shows a unique non-planar embodiment of the beamformer of the invention. Because the RF waveguide circuit is so thin, it can be formed into almost any 3D shape. The only restrictions are that the material should be flat where the input and output connectors reside and the bend radius can't be so tight that the substrate material is damaged. This characteristic allows the beamformer to be formed in a way that provides the most efficient packaging in its next higher assembly, greatly increasing the ability to use the available space. In the embodiment of FIG. 6, beamformer 600 includes a first flat section 602, a sloped section 604, and a second flat section 606. These sections correspond to first flat sections, sloped sections, and second flat sections of the backplate and dielectric substrate. As will be understood, a non-planar dielectric substrate sheet 610 and a corresponding non-planar conductive backplate 630 should include similarly shaped flat sections and sloped sections so that they can be mated together using the preform. Likewise, the preform 620 is sized (i.e., made longer) to account for the sloped area. The circuitry on the beamformer is arranged so that the input and output pins and their associated ground shrouds are located on the flat sections of the beamformer (i.e., not on the sloped section).

Figure 7:
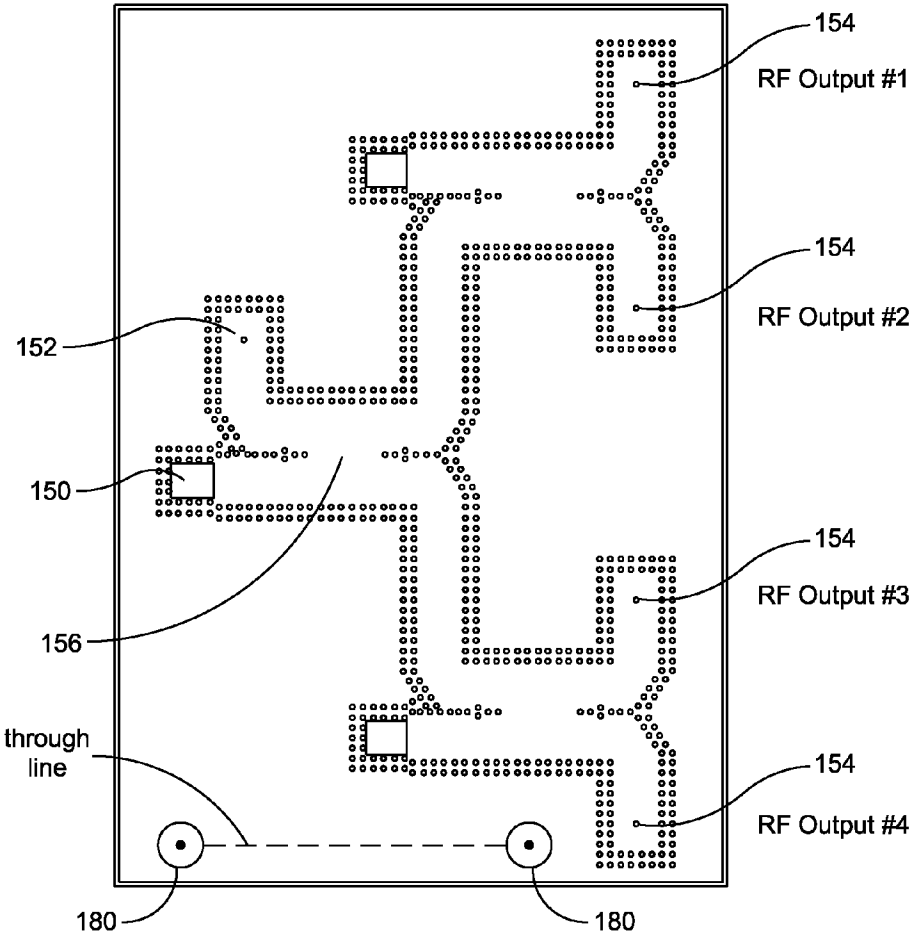
FIG. 7 shows an embodiment of the invention in which the beamformer circuit is a 1:4 divider or combiner and also shows a connectorized through line that may be implemented in an embodiment.

FIG. 7 shows an embodiment of the invention in which the beamformer circuit is a 1:4 divider or combiner. Because of the high performance of the beamformer, multiple 1:2 divider/combiner circuits 156 may be nested to create 1:N divider/combiner circuits. When used as a 1:4 divider as shown in FIG. 7, one of the ports is an RF waveguide input port 152 and four may be RF waveguide output ports 154. As will be understood, each 1:2 divider of the beamformer circuit includes a termination port for an RF absorber 150. Coax connectors 180 may be provided at the input/output ports of the 1:N circuit as disclosed herein.

FIG. 7 also shows a connectorized throughput line that may be implemented in an embodiment of the beamformer. The throughput line includes throughput input and output coaxial connectors 180 and transmits the high frequency RF energy from one connector to the other. As will be understood, the throughput line enables a signal to be passed from below the beamformer to above the beamformer or vice versa. In the tight spacing of phased array antennas and subassemblies, the connectorized throughput line makes it possible to pass through signals without the need for added cabling. The throughput connectors are implemented in the same way as the connectors for the RF waveguide circuit, with appropriate throughput input holes and throughput output holes in the conductive preform (preform throughput input holes and preform throughput output holes) and in the dielectric substrate (substrate throughput input holes and substrate throughput output holes), a throughput input pin with a head section and a throughput output pin with a head section that are generally coplanar with the conductive preform, and throughput input and output pin body sections of the throughput input and output pins that extend from the head sections through the substrate throughput input and output holes. The throughput connectors may also include a throughput input ground shroud and a throughput output ground shroud connected to the other side of the dielectric substrate that complete the throughput input coaxial connection and the throughput output coaxial connection.

Figure 8:
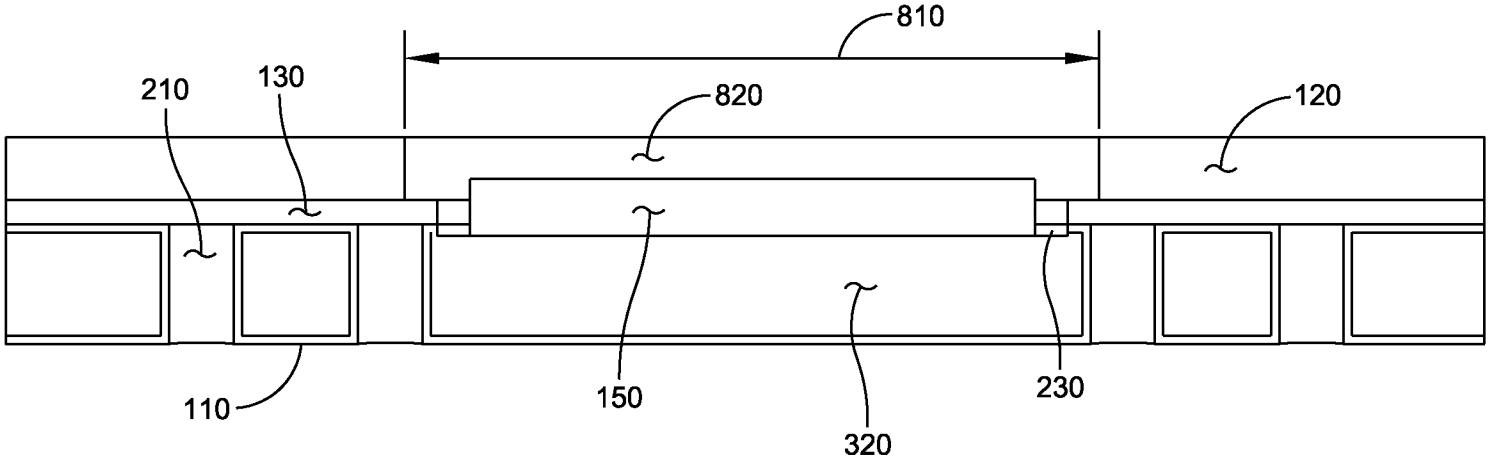
FIG. 8 is a section view of the beamformer at the RF Absorber in another embodiment of the invention.
Figure 9:
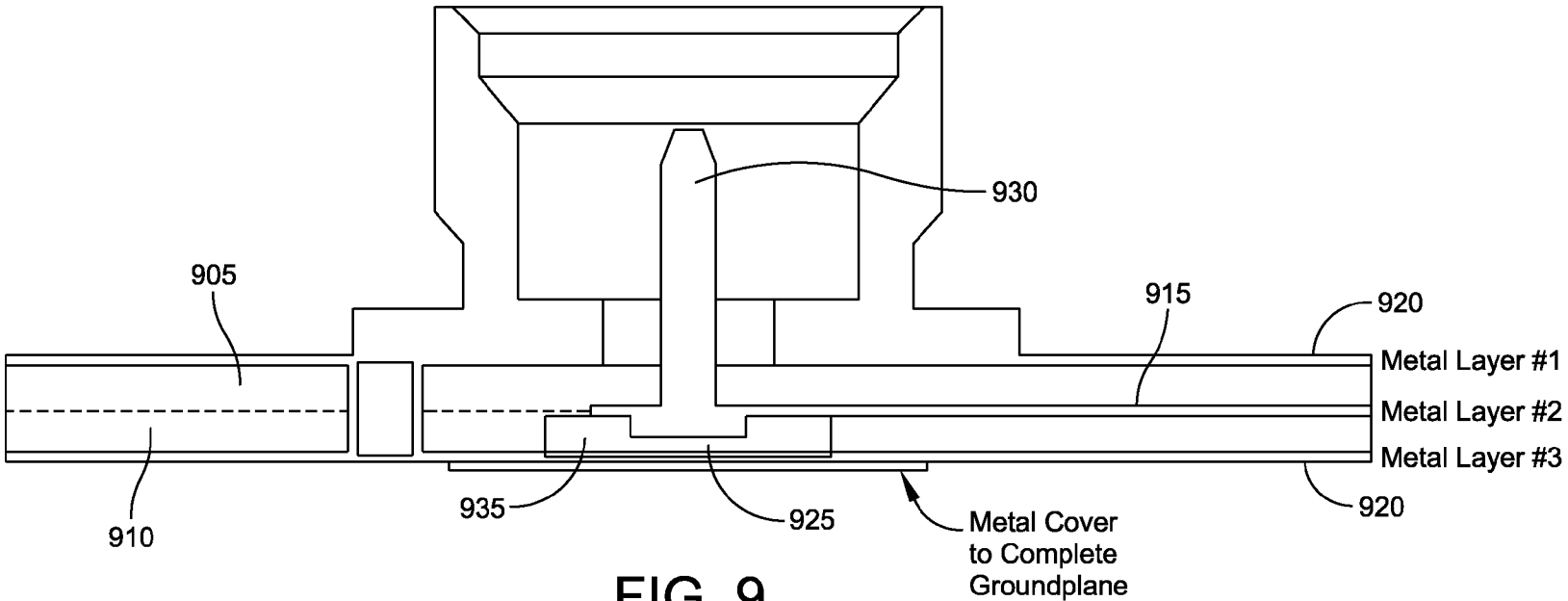
FIG. 9 is a notional cross-sectional representation of a prior-art stripline beamformer.

FIG. 8 shows a cross-section of the beamformer 100 which includes the RF absorber 150 in termination port 230 (as shown on FIG. 2B). In this embodiment, backplate 120 includes an opening 810 coincident with the RF absorber 150, rather than a recess 310 as shown in FIG. 3. This configuration allows the RF absorber 150 to be installed through the opening, which may allow for a more precise placement of the RF absorber 150 on the opening in the copper cladding 240 (as shown in FIG. 2B) of the dielectric substrate sheet 110. After the RF absorber 150 is placed within the opening and onto the opening in the copper cladding 240, the opening in the backplate 810 may be filled with an epoxy backfill 820 to hold the RF absorber in place. The epoxy backfill may be electrically conductive. After the backfill has been placed, the RF absorber configuration of the embodiment of FIG. 8 should operate similarly to the embodiment of FIG. 3 to allow RF energy to travel into the RF absorber region of the load port without discontinuities which cause reflections. The backfill provides a path for heatsinking the RF absorber material and the RF performance of the termination may provide excellent return loss by selecting a thin (10 mils for a 35 GHz coupler) commercially available absorbing material of low dielectric constant (such as Eccosorb type BSR) which does not cause a discontinuity as energy travels into the termination port 320. As with the embodiment of FIG. 3, the length of the absorber is selected to insure the input RF energy is dissipated by the time it reaches the end of the absorber.

A method for fabricating a waveguide beamformer may comprise providing a dielectric substrate sheet having conductive cladding and providing a conductive backplate sheet. A waveguide circuit is formed on the dielectric substrate sheet, and a substrate input pin hole is drilled in the dielectric substrate sheet corresponding to a waveguide circuit input. Likewise, a substrate output pin hole is drilled in the dielectric substrate sheet corresponding to a waveguide circuit output. The conductive preform is mated to the conductive backplate sheet, the conductive preform including a preform input pin hole coaxial with the substrate input pin hole and a preform output pin hole coaxial with the substrate output pin hole. An input pin is coaxially disposed within the preform input pin hole and the substrate input pin hole such that an input pin head section is generally coplanar with the preform input pin hole and an input pin body section extends perpendicularly away from the conductive backplate. Also, an output pin is coaxially disposed within the preform output pin hole and the substrate output pin hole such that an output pin head section is generally coplanar with the preform output pin hole and an output pin body section extends perpendicularly from the conductive backplate. The dielectric substrate sheet is mated to the conductive preform such that the substrate input pin hole is coaxial with the input pin and the substrate output pin hole is coaxial with the output pin, thereby sandwiching the conductive preform, the input pin head section and the output pin head section between the conductive backplate sheet and the dielectric substrate sheet.

The method for fabricating the waveguide beamformer may also include attaching an input coaxial ground shroud to the second side of the dielectric substrate sheet coaxially with an input pin body section of the input pin thereby creating an input coaxial connection. Likewise, an output coaxial ground shroud may be attached to the second side of the dielectric substrate sheet coaxially with an output pin body section of the output pin, thereby creating an output coaxial connection. The waveguide circuit may be formed on the dielectric substrate sheet by drilling circuit holes through the dielectric substrate sheet and plating the circuit holes with a conductive material, thereby creating ground vias forming the waveguide circuit.

The method for fabricating the waveguide beamformer may also include making provisions for a RF waveguide absorber that corresponds to an RF waveguide termination point. The conductive preform further includes a preform RF absorber opening aligned with a waveguide circuit termination point.

A substrate RF absorber opening is etched in the conductive cladding of a first side of the dielectric substrate sheet, aligned with the waveguide circuit termination point. And then an RF absorber is positioned within the substrate RF absorber opening and the preform RF absorber opening. Mating the dielectric substrate sheet to the conductive preform further results in sandwiching the RF absorber between the conductive backplate sheet and the dielectric substrate sheet. In an embodiment, a backplate RF absorber recess is machined in the conductive backplate sheet aligned with the waveguide circuit termination point, and positioning the RF absorber within the substrate RF absorber opening and the preform RF absorber opening further comprises positioning the RF absorber within the backplate RF absorber recess. In another embodiment, providing a conductive backplate sheet comprises providing a conductive backplate sheet with an RF absorber opening machined in the conductive backplate sheet aligned with the waveguide circuit termination point. Positioning the RF absorber within the substrate RF absorber opening and the preform RF absorber opening then comprises disposing the RF absorber through the conductive backplate RF absorber opening and within the substrate RF absorber opening and the preform RF absorber opening, and further comprising epoxy backfilling the conductive backplate RF absorber opening after the RF absorber has been disposed.

The method for fabricating the waveguide beamformer may also include soldering an input pin head section portion adjacent to the dielectric substrate sheet to the conductive cladding of the dielectric substrate sheet and soldering an output pin head section portion adjacent to the dielectric substrate sheet to the conductive cladding of the dielectric substrate sheet.

In an embodiment of the waveguide beamformer, the input pin head section is an input pin shoulder section and the output pin head section is an output pin shoulder section. The input pin further comprises an input pin upper body section that extends perpendicularly from the input pin shoulder section on an opposite side to the input pin body section. Similarly, the output pin further comprises an output pin upper body section that extends perpendicularly from the output pin shoulder section on an opposite side to the output pin body section. The conductive backplate sheet includes a backplate input pin hole and a backplate output pin hole. The input pin upper body section is disposed within the backplate input pin hole and the output pin upper body section is disposed within the backplate output pin hole. Disposing the input pin upper body section within the backplate input pin hole may comprise press fitting the input pin upper body section into the backplate input pin hole and disposing the output pin upper body section within the backplate output pin hole may comprise press fitting the output pin upper body section into the backplate output pin hole. In another embodiment, disposing the input pin upper body section within the backplate input pin hole comprises epoxying the input pin upper body section into the backplate input pin hole and disposing the output pin upper body section within the backplate output pin hole comprises epoxying the output pin upper body section within the backplate output pin hole.

The method of fabricating a waveguide beamformer may also comprise providing a non-planar dielectric substrate sheet with a conductive cladding having at least one flat substrate section and providing a non-planar conductive backplate sheet having at least one flat backplate section, wherein the non-planar conductive backplate sheet is substantially similar in shape to the non-planar dielectric substrate sheet. Forming the waveguide circuit on the dielectric substrate sheet may comprise forming the waveguide circuit so the waveguide circuit input and the waveguide circuit output are located on the flat substrate section and the flat backplate section.

What is claimed is:

1. A waveguide beamformer comprising:

a dielectric substrate sheet with conductive cladding including an RF circuit, a substrate input pin hole corresponding to an RF circuit input, and a substrate output pin hole corresponding to an RF circuit output;

a conductive preform adjacent to a first side of the dielectric substrate sheet, the conductive preform including a preform input pin hole coaxial with the substrate input pin hole, and a preform output pin hole coaxial with the substrate output pin hole;

an input pin disposed coaxially within the preform input pin hole and the substrate input pin hole, the input pin having an input pin head section and input pin body section, wherein the input pin head section is generally coplanar with the conductive preform and the input pin body section extends perpendicularly from the input pin head section through the substrate input pin hole;

an output pin disposed coaxially within the preform output pin hole and the substrate output pin hole, the output pin having an output pin head section and output pin body section, wherein the output pin head section is generally coplanar with the conductive preform and the output pin body section extends perpendicularly from the output pin head section through the substrate output pin hole; and a conductive backplate adjacent to the conductive preform, the conductive backplate and the dielectric substrate sheet sandwiching the conductive preform, the input pin head section and the output pin head section.

2. The waveguide beamformer of claim 1, further comprising an input ground shroud attached to a second side of the dielectric substrate sheet and coaxial with the input pin body section, thereby creating an input coaxial connection; and an output ground shroud attached to the second side of the dielectric substrate sheet and coaxial with the output pin body section, thereby creating an output coaxial connection.

3. The waveguide beamformer of claim 1, wherein the RF circuit is comprised of plated ground vias in the dielectric substrate sheet.

4. The waveguide beamformer of claim 1, wherein the conductive cladding on the dielectric substrate sheet is comprised of copper.

5. The waveguide beamformer of claim 1, wherein the conductive preform is comprised of epoxy or solder.

6. The waveguide beamformer of claim 1, wherein the conductive backplate is made from stainless steel, copper, or brass.

7. The waveguide beamformer of claim 1, wherein the dielectric substrate sheet further comprises a substrate RF absorber opening in the conductive cladding aligned with an RF circuit termination point; and the conductive preform further comprises a preform RF absorber opening aligned with the substrate RF absorber opening;

and further comprising an RF absorber adjacent to the dielectric substrate sheet and disposed within the substrate RF absorber opening and the preform RF absorber opening;

and wherein the conductive backplate and the dielectric substrate sheet further sandwich the RF absorber.

8. The waveguide beamformer of claim 7, wherein the RF absorber comprises a low dielectric constant absorbing material.

9. The waveguide beamformer of claim 7, wherein the conductive backplate includes an RF absorber recess aligned with the RF circuit termination point and wherein the RF absorber further is disposed within the RF absorber recess.

10. The waveguide beamformer of claim 1, wherein an input pin head section portion adjacent to the dielectric substrate sheet is soldered to the conductive cladding of the dielectric substrate sheet and an output pin head section portion adjacent to the dielectric substrate sheet is soldered to the conductive cladding of the dielectric substrate sheet.

11. The waveguide beamformer of claim 1, wherein:

the input pin head section is an input pin shoulder section and the output pin head section is an output pin shoulder section;

the input pin further comprises an input pin upper body section that extends perpendicularly from the input pin shoulder section on an opposite side to the input pin body section;

the output pin further comprises an output pin upper body section that extends perpendicularly from the output pin shoulder section on an opposite side to the output pin body section;

the conductive backplate includes a backplate input pin hole and a backplate output pin hole;

the input pin upper body section is coaxially disposed within the backplate input pin hole; and the output pin upper body section is coaxially disposed within the backplate output pin hole.

12. The waveguide beamformer of claim 10, wherein an input pin shoulder section portion adjacent to the dielectric substrate sheet is attached to the conductive cladding of the dielectric substrate sheet with solder, and an output pin shoulder head section portion adjacent to the dielectric substrate sheet is attached to the conductive cladding of the dielectric substrate sheet with solder.

13. The waveguide beamformer of claim 2, wherein the input ground shroud is attached to a second side of the dielectric substrate sheet with solder and wherein the output ground shroud is attached to a second side of the dielectric substrate sheet with solder.

14. The waveguide beamformer of claim 1, wherein the dielectric substrate sheet, the conductive preform, and the conductive backplate are non-planar.

15. The waveguide beamformer of claim 2, wherein the dielectric substrate sheet includes a substrate first flat section, a substrate sloped section, and a substrate second flat section;

the conductive backplate includes a backplate first flat section, a backplate sloped section, and a backplate second flat section that mirror the substrate first flat section, the substrate sloped section, and the substrate second flat section;

the input pin, the output pin, the input ground shroud, and the output ground shroud are disposed within the backplate first flat section, the backplate second flat section, the substrate first flat section, or the substrate second flat section.

16. The waveguide beamformer of claim 1, wherein the dielectric substrate sheet with the conductive cladding further includes a substrate throughput input hole and a substrate throughput output hole;

the conductive preform further includes a preform throughput input hole coaxial with the substrate throughput input hole and a preform throughput output hole coaxial with the substrate throughput output hole;

and further comprising a throughput input pin disposed coaxially within the preform throughput input hole and the substrate throughput input hole, wherein a throughput input pin head section is generally coplanar with the preform throughput input hole; and a throughput output pin disposed coaxially within the preform throughput output hole and the substrate throughput output hole, wherein a throughput output pin head section is generally coplanar with the preform throughput input hole; and wherein the conductive backplate and the dielectric substrate sheet thereby further sandwich the throughput input pin head section and the throughput output pin head section;

and further comprising:

a throughput input ground shroud attached to a second side of the dielectric substrate sheet in concentric relation with the throughput input pin, thereby creating an throughput input coaxial connection; and a throughput output ground shroud attached to the second side of the dielectric substrate sheet in concentric relation with the throughput output pin, thereby creating an throughput output coaxial connection.

17. A method for fabricating a waveguide beamformer comprising:

providing a dielectric substrate sheet having conductive cladding;

forming a waveguide circuit on the dielectric substrate sheet;

forming a substrate input pin hole in the dielectric substrate sheet corresponding to a waveguide circuit input;

forming a substrate output pin hole in the dielectric substrate sheet corresponding to a waveguide circuit output;

providing a conductive backplate sheet;

mating a conductive preform to the conductive backplate sheet, the conductive preform including a preform input pin hole coaxial with the substrate input pin hole and a preform output pin hole coaxial with the substrate output pin hole;

disposing an input pin coaxially within the preform input pin hole and the substrate input pin hole such that an input pin head section is generally coplanar with the preform input pin hole and an input pin body section extends perpendicularly away from the conductive backplate;

disposing an output pin coaxially within the preform output pin hole and the substrate output pin hole such that an output pin head section is generally coplanar with the preform output pin hole and an output pin body section extends perpendicularly from the conductive backplate; and mating the dielectric substrate sheet to the conductive preform such that the substrate input pin hole is coaxial with the input pin and the substrate output pin hole is coaxial with the output pin, thereby sandwiching the conductive preform, the input pin head section and the output pin head section between the conductive backplate sheet and the dielectric substrate sheet.

18. The method of claim 17, further comprising:

attaching an input coaxial ground shroud to the second side of the dielectric substrate sheet coaxially with an input pin body section of the input pin thereby creating an input coaxial connection; and attaching an output coaxial ground shroud to the second side of the dielectric substrate sheet coaxially with an output pin body section of the output pin, thereby creating an output coaxial connection.

19. The method of claim 17, wherein forming the waveguide circuit on the dielectric substrate sheet comprises drilling circuit holes through the dielectric substrate sheet and plating the circuit holes with a conductive material, thereby creating ground vias forming the waveguide circuit.

20. The method of claim 17, wherein the conductive preform further includes a preform RF absorber opening aligned with a waveguide circuit termination point; and further comprising etching a substrate RF absorber opening in the conductive cladding of a first side of the dielectric substrate sheet, aligned with the waveguide circuit termination point; and further comprising positioning an RF absorber within the substrate RF absorber opening and the preform RF absorber opening;

and wherein mating the dielectric substrate sheet to the conductive preform further results in sandwiching the RF absorber between the conductive backplate sheet and the dielectric substrate sheet.

21. The method of claim 20, further comprising machining a backplate RF absorber recess in the conductive backplate sheet aligned with the waveguide circuit termination point; and wherein positioning the RF absorber within the substrate RF absorber opening and the preform RF absorber opening further comprises positioning the RF absorber within the backplate RF absorber recess.

22. The method of claim 20, wherein providing a conductive backplate sheet comprises providing a conductive backplate sheet with an RF absorber opening machined in the conductive backplate sheet aligned with the waveguide circuit termination point, and wherein positioning the RF absorber within the substrate RF absorber opening and the preform RF absorber opening comprises disposing the RF absorber through the conductive backplate RF absorber opening and within the substrate RF absorber opening and the preform RF absorber opening, and further comprising epoxy backfilling the conductive backplate RF absorber opening after the RF absorber has been disposed.

23. The method of claim 17, further comprising soldering an input pin head section portion adjacent to the dielectric substrate sheet to the conductive cladding of the dielectric substrate sheet and soldering an output pin head section portion adjacent to the dielectric substrate sheet to the conductive cladding of the dielectric substrate sheet.

24. The method of claim 17, wherein the input pin head section is an input pin shoulder section and the output pin head section is an output pin shoulder section;

the input pin further comprises an input pin upper body section that extends perpendicularly from the input pin shoulder section on an opposite side to the input pin body section;

the output pin further comprises an output pin upper body section that extends perpendicularly from the output pin shoulder section on an opposite side to the output pin body section;

the conductive backplate sheet includes a backplate input pin hole and a backplate output pin hole;

and further comprising:

disposing the input pin upper body section within the backplate input pin hole; and disposing the output pin upper body section within the backplate output pin hole when mating the conductive backplate sheet to the conductive preform.

25. The method of claim 24, wherein disposing the input pin upper body section within the backplate input pin hole comprises press fitting the input pin upper body section into the backplate input pin hole and wherein disposing the output pin upper body section within the backplate output pin hole comprises press fitting the output pin upper body section into the backplate output pin hole.

26. The method of claim 24, wherein disposing the input pin upper body section within the backplate input pin hole comprises epoxying the input pin upper body section into the backplate input pin hole and wherein disposing the output pin upper body section within the backplate output pin hole comprises epoxying the output pin upper body section within the backplate output pin hole.

27. The method of claim 17, wherein providing a dielectric substrate sheet comprises providing a non-planar dielectric substrate sheet with a conductive cladding having at least one flat substrate section;

providing the conductive backplate sheet comprises providing a non-planar conductive backplate sheet having at least one flat backplate section, wherein the non-planar conductive backplate sheet is substantially similar in shape to the non-planar dielectric substrate sheet; and forming the waveguide circuit on the dielectric substrate sheet comprises forming the waveguide circuit so the waveguide circuit input and the waveguide circuit output are located on the flat substrate section and the flat backplate section.

* * * * *